US006006645A

United States Patent [19]

Breuer et al.

[11] Patent Number: 6,006,645

[45] Date of Patent: Dec. 28, 1999

[54] EXTERNALLY DRIVEN TRANSVERSE WEDGE-TYPE BREECHBLOCK FOR A LARGE-CALIBER WEAPON

[75] Inventors: Heinz-Günter Breuer; Hans Hulsewis, both of Duisburg, Germany

[73] Assignee: Rheinmetall W & M GmbH, Unterlüss, Germany

[21] Appl. No.: 09/112,203

[22] Filed: Jul. 9, 1998

[30] Foreign Application Priority Data

Jul. 9, 1997 [DE] Germany ..... 197 29 293
May 28, 1998 [DE] Germany ..... 198 23 785

[51] Int. Cl.[6] ..... F41A 3/00

[52] U.S. Cl. ..... 89/24; 89/17

[58] Field of Search ..... 89/24, 17, 23, 89/43.01

[56] References Cited

U.S. PATENT DOCUMENTS

| | | | |
|---|---|---|---|
| 742,702 | 10/1903 | Meigs et al. | 89/4.1 |
| 1,707,444 | 4/1929 | McCann | 89/24 |
| 2,434,970 | 1/1948 | Summerbell | 89/4.05 |
| 2,802,400 | 8/1957 | Edmund | 89/24 |
| 3,355,988 | 12/1967 | D'Andrea | 89/45 |
| 3,399,598 | 9/1968 | Hornfeck et al. | 89/24 |
| 3,678,001 | 7/1972 | Brint | 89/24 |
| 4,341,031 | 7/1982 | Palmer et al. | 42/23 |
| 4,462,299 | 7/1984 | Grunewald et al. | 89/24 |
| 5,481,958 | 1/1996 | Balbo et al. | 89/45 |
| 5,663,521 | 9/1997 | Mandereau et al. | 89/37.08 |
| 5,675,108 | 10/1997 | Balbo et al. | 89/22 |

FOREIGN PATENT DOCUMENTS

| | | |
|---|---|---|
| 1137190 | 12/1968 | United Kingdom . |
| 1255921 | 12/1971 | United Kingdom . |

*Primary Examiner*—Charles T. Jordan
*Assistant Examiner*—Jeff Howell
*Attorney, Agent, or Firm*—Venable; Gabor J. Kelemen

[57] ABSTRACT

A large-caliber weapon includes a barrel having a longitudinal barrel axis; a cradle supporting the barrel; a breech ring mounted on an end of the barrel; a breech wedge disposed in the breech ring for linear displacements transversely to the barrel axis; a control lug affixed to the breech wedge; and an opening lever pivotally mounted on the cradle for angular displacements about a lever axis oriented perpendicularly to the barrel axis. The opening lever is disposed externally of the breech ring and has an initial position and an actuated end position. The opening lever is engaged by the control lug of the breech wedge in a position of rest of the barrel such that upon motion of the opening lever from its initial position to its actuated end position, the breech wedge is moved from a closed position into an open position. Further, an external drive is provided which is mounted on the cradle and a mechanical coupling mechanism connects the external drive to the opening lever for effecting pivotal motion of the opening lever.

18 Claims, 6 Drawing Sheets

EXTERNALLY DRIVEN TRANSVERSE WEDGE-TYPE BREECHBLOCK FOR A LARGE-CALIBER WEAPON

CROSS REFERENCE TO RELATED APPLICATION

This application claims the priority of German Application Nos. 197 29 293.3 filed Jul. 9, 1997 and 198 23 785.5 filed May 28, 1998, which are incorporated herein by reference.

BACKGROUND OF THE INVENTION

This invention relates to an externally driven transverse wedge-type breechblock for a large-caliber weapon having a weapon barrel. The breechblock includes a breech ring as well as a breech wedge which is displaceable in the breech ring transversely to the barrel axis.

German Offenlegungsschrift (application published without examination) 39 14 538 describes a wedge-type breechblock which permits an automatic opening of the breech wedge by means of an external drive mounted on the weapon cradle. For this purpose, the breech wedge is arranged in an opening approximately in the middle of the breech ring and is shiftable by means of an opening shaft disposed perpendicularly to the barrel axis. The opening shaft is connected with the external drive by means of a toothed rack oriented parallel to the barrel axis.

The externally driven transverse wedge-type breechblock of the above-outlined kind has, among others, the disadvantage that the control arrangement for opening the breechblock is relatively complex. Further, the breech ring must be of very robust construction for safety reasons because it has a relatively large aperture for the breech wedge and additional apertures for the opening shaft and the toothed rack.

SUMMARY OF THE INVENTION

It is an object of the invention to provide an improved externally driven transverse wedge-type breechblock of the above-outlined type which is of simple construction and wherein the breech wedge is opened by a simple motion processes.

This object and others to become apparent as the specification progresses, are accomplished by the invention, according to which, briefly stated, the large-caliber weapon includes a barrel having a longitudinal barrel axis; a cradle supporting the barrel; a breech ring mounted on an end of the barrel; a breech wedge disposed in the breech ring for linear displacements transversely to the barrel axis; a control lug affixed to the breech wedge; and an opening lever pivotally mounted on the cradle for angular displacements about a lever axis oriented perpendicularly to the barrel axis. The opening lever is disposed externally of the breech ring and has an initial position and an actuated end position. The opening lever is engaged by the control lug of the breech wedge in a position of rest of the barrel such that upon motion of the opening lever from its initial position to its actuated end position, the breech wedge is moved from a closed position into an open position. Further, an external drive is provided which is mounted on the cradle and a mechanical coupling mechanism connects the external drive to the opening lever for effecting pivotal motion of the opening lever.

Thus, according to the essence of the invention, the breech wedge which forms part of the transverse wedge-type breechblock and which is shiftable transversely to the barrel axis, is provided with at least one control lug which engages an end of an opening lever mounted on the weapon cradle externally of the breech ring and pivotal about a rotary axis oriented perpendicularly to the barrel axis. Such an engagement is effected so that a pivotal motion of the opening lever from its initial position into its end position effected by means of the external drive causes a shift of the breech wedge from its closed position into its open position.

By virtue of the above-outlined construction of the breechblock according to the invention, all the essential components required for controlling the breechblock may be disposed on the weapon cradle externally of the breech ring and the breech wedge and are unaffected by the recoil of the weapon. Further, the number of apertures in the breech ring and the breech wedge may be significantly reduced. As a result, the breechblock according to the invention is less prone to malfunctioning than comparable conventional breechblocks. Further, the inventive breechblock concept may find application in manually loaded weapons, as well as in weapons which cooperate with an automatic loading apparatus.

In case of a horizontally shiftable wedge-type breechblock, it is a further result of the invention that for opening and closing the breechblock only small opening and closing forces are required. In case of a vertical wedge-type breechblock for reducing the opening and closing forces, preferably weight-compensating springs are arranged between the breech ring and the breech wedge.

According to a preferred embodiment of the invention, the opening lever is structured such that a hand grip may be inserted on the opening lever so that as an emergency measure, a manual opening of the breechblock is also possible.

The coupling between the external drive and the opening lever, both mounted on the weapon cradle, may be effected, for example, by a gear or crank drive or a linkage system.

According to a further advantageous feature of the invention, between the opening lever and a stationary part of the cradle a spring, preferably a gas spring, is arranged which is armed during the opening motion of the opening lever, and which serves as a closing spring for the opening lever and, in some constructions, for the breech wedge as well.

DESCRIPTION OF THE PREFERRED EMBODIMENTS

Figure 1:
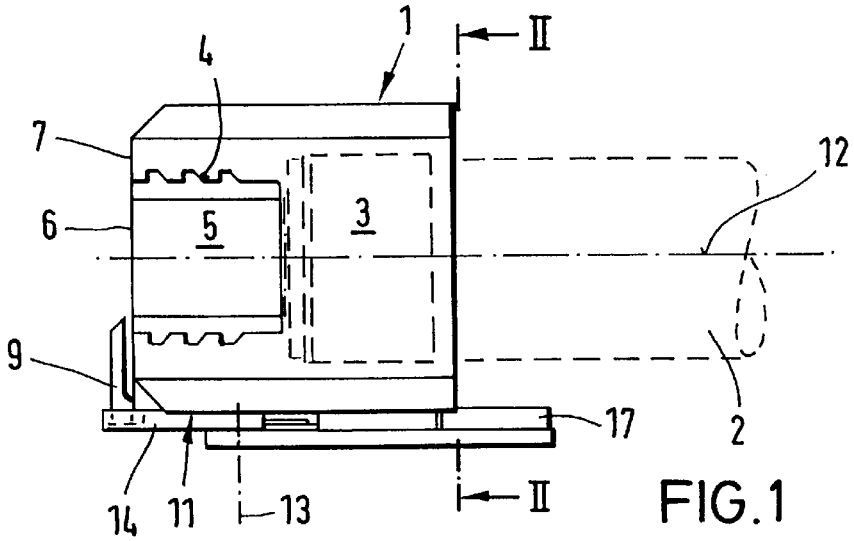
FIG. 1 is a side elevational view of a first preferred embodiment of a horizontal wedge-type breechblock according to the invention, including a breech wedge and a centrally arranged opening lever operable by an external drive.
Figure 2:
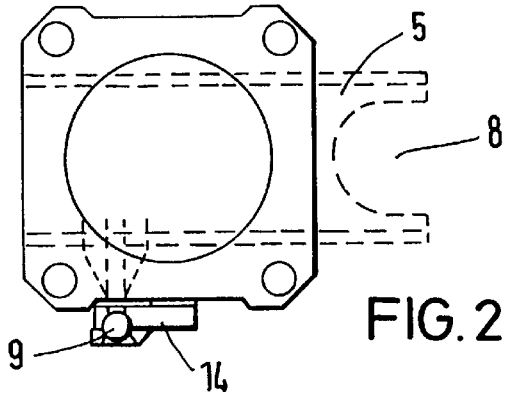
FIG. 2 is a front elevational view along line II—II of FIG. 1.
Figure 3:
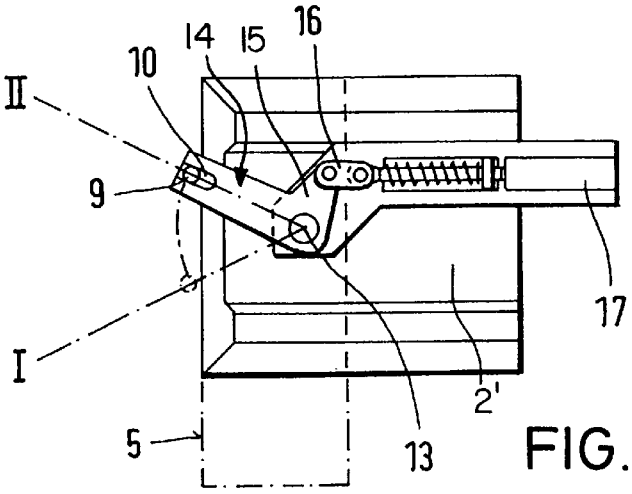
FIG. 3 is a bottom plan view of the construction shown in FIGS. 1 and 2.

FIGS. 1, 2 and 3 show a horizontal wedge-type breechblock 1, of, for example, a tank weapon. The breechblock 1 includes a breech ring 3 connected to a weapon barrel 2 and a breech wedge 5 which is supported in the breech ring 3 and which is horizontally shiftable by means of a toothed component 4. The rear faces 6 and 7 of the breech wedge 5 and the breech ring 3, respectively, are disposed in a common plane.

The breech wedge 5 is, for example, by means of a closing spring attached to the rear edge of the breech ring 3 and not illustrated for the sake of better visibility, maintained in its closed position illustrated in broken lines in FIGS. 2 and 3. The breech wedge 5 is provided with a loading tray 8.

A control lug 9 is secured approximately centrally to the rear face 6 of the breech wedge 5. As shown in FIG. 3, the control lug 9 extends into a fork 10 provided at an end of an opening lever 14 which is situated at the underside 11 of the breech ring 3 and which is pivotal about a rotary axis 13 oriented perpendicularly to the axis 12 of the weapon barrel 2. This arrangement is such that upon a pivotal displacement of the opening lever 14 from its initial position I into its actuated end position II, a shifting motion of the breech wedge 5 occurs from its closed position into its open position. According to the invention, the opening lever 14 is pivotally mounted on the weapon cradle designated at 2' in FIG. 3.

In the embodiment illustrated in FIGS. 1, 2 and 3 the opening lever 14 is a two-armed structure and is connected with an external drive 17 (for example, an electric motor) mounted on the cradle 2'. The lever arm 15 of the opening lever 14, situated remote from the control lug 9, is coupled to the external drive 17 by means of a schematically illustrated transmission linkage 16.

During the opening process, for example, after firing the weapon, the external drive 17 shifts the linkage 16 and thus pivots the opening lever 14 which, in turn, moves the breech wedge 5 by virtue of its connection to the opening lever 14 via the control lug 9. During this occurrence, the non-illustrated closing spring is armed and at the end of the opening stroke the non-illustrated ejector is actuated and the cartridge case (or the case bottom, if the cartridge case is combustible) is pulled out. The fully opened breechblock is thereafter locked by the biased closing spring.

After loading a new cartridge into the weapon, a cartridge inserting device, which is part of an automatic loading device not shown for better visibility, is pivoted away from the region of the breech wedge 5 and actuates the breechblock lock. The biased closing spring then shifts the breech wedge 5 back into its initial position so that the breechblock is closed and the weapon is ready for firing.

After firing the weapon, the weapon barrel 2 recoils together with the breechblock 1, and the control lug 9 slides out of the fork 10 of the opening lever 14. Subsequently, during the counter-recoil of the weapon barrel 2 and in the closed state of the breechblock 1, the control lug 9 runs again into the recess of the fork 10 of the opening lever 14.

Figure 4:
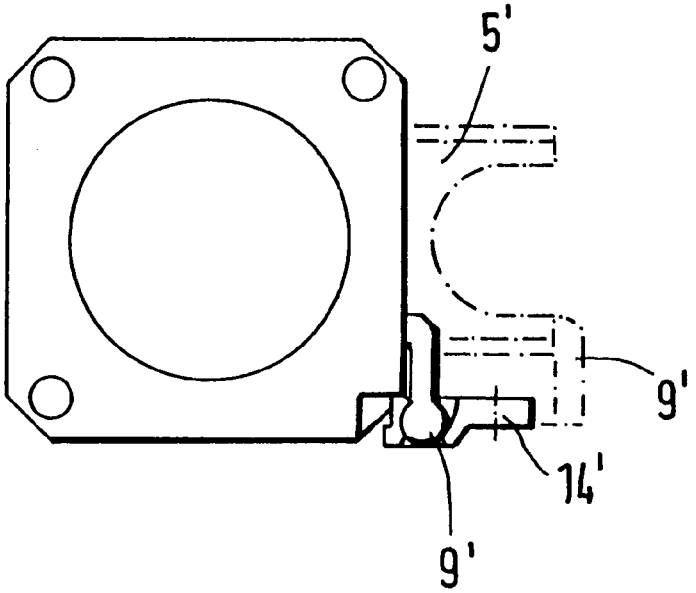
FIG. 4 is a front elevational view of a second preferred embodiment of a horizontal wedge-type breechblock according to the invention.
Figure 5:
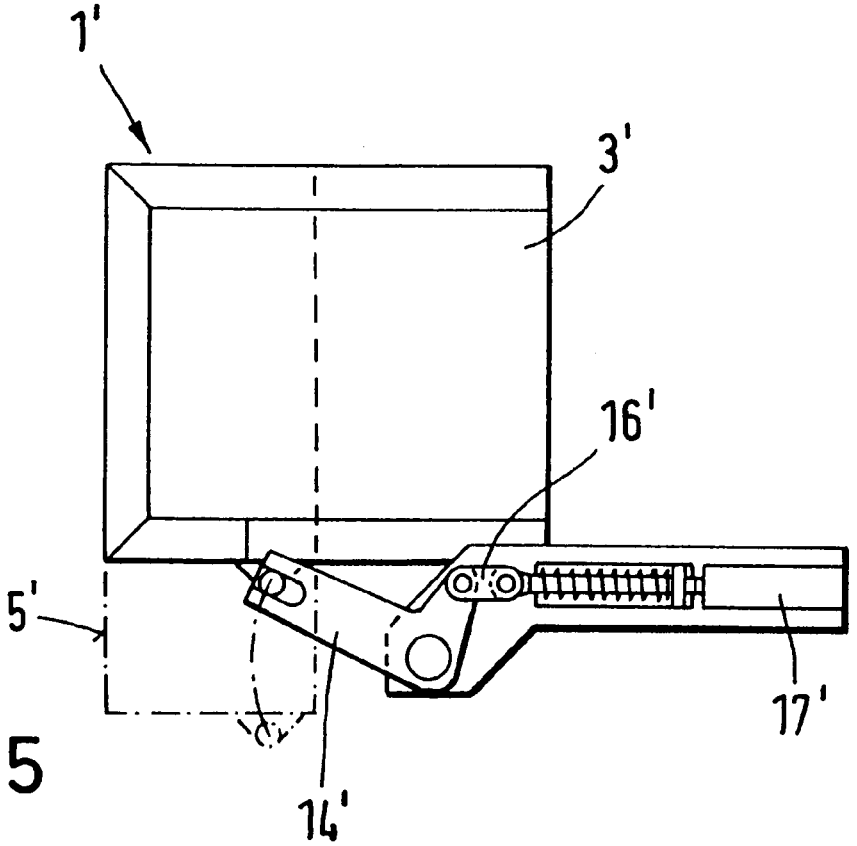
FIG. 5 is a side elevational vie of the structure of FIG. 4.

FIGS. 4 and 5 illustrate a second embodiment of a horizontal wedge-type breechblock 1'. This embodiment differs from the previously described structure essentially in that the control lug 9' mounted-on the breech wedge 5' is situated at the side of the loading tray, at the outer zone of the breech wedge St. Accordingly, the opening lever 14', the external drive 17' and the transmission linkage 16' are also arranged laterally underneath or above the breech ring 3'.

While a central arrangement of the control lug (FIGS. 1–3) requires that the rear faces 6 and 7 of the breech wedge and the breech ring lie in a common plane, in a lateral arrangement of the control lug 9' (FIGS. 4 and 5) no such requirement exists.

It is to be understood that the invention is not limited to the embodiments illustrated in FIGS. 1–5. Thus, for example, the opening lever need not necessarily be a two-arm lever to be driven by a transmission linkage from the external drive.

FIGS. 6–10 show several embodiments in which, in each instance, a substantially one-arm opening lever is used.

Figure 6:
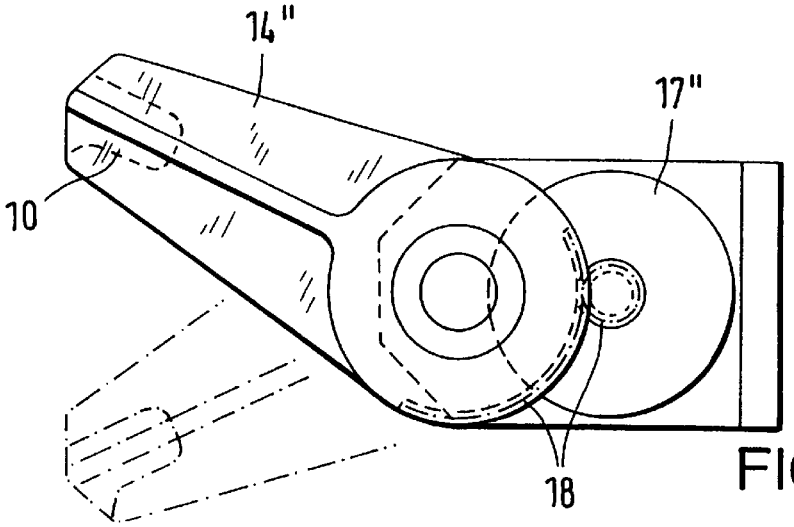
FIGS. 6–10 are side elevational views of diverse embodiments of transfer members, by means of which the motion of the external drive is converted to a required pivotal motion of the opening lever for opening the breech wedge.

Thus, in FIG. 6, the opening lever 14" is connected with the external drive 17" constituted by an electric motor, by means of a gear drive 18.

Figure 7:
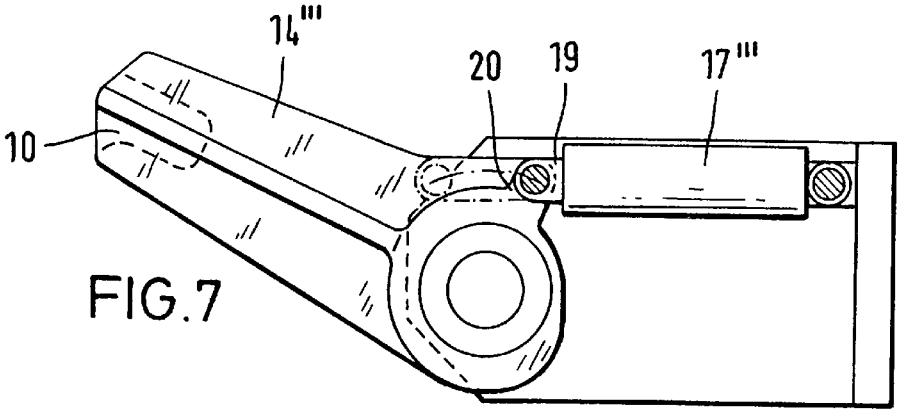

In FIG. 7 the opening lever 14''' is pivoted by means of a hydraulic external drive 17''' wherein the piston rod 19 of the external drive 17''' engages laterally a crank arm 20 of the opening lever 14'''.

Figure 8:
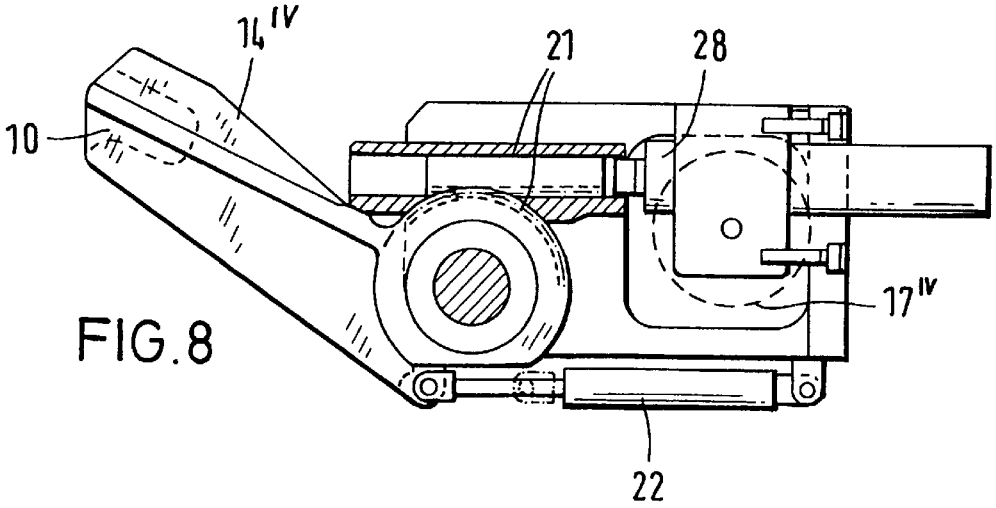

FIG. 8 shows an opening lever $\mathbf{14}^{IV}$ operated by an electric motor constituting an external drive $\mathbf{17}^{IV}$ which is connected with the opening lever $\mathbf{14}^{IV}$ by means of a spindle 28 and a rack-and-pinion drive 21. Further, a gas spring 22 is provided which, upon pivotal motion of the opening lever $\mathbf{14}^{IV}$, is armed as it is moved from the retracted position into the expanded position. The gas spring 22, dependent on its design, may serve either to merely pivot the opening lever $\mathbf{14}^{IV}$ into its initial position after the breechblock is opened, or may additionally be used as a closing spring for the breechblock, in which case the closing spring for the breech wedge conventionally mounted on the breech ring of the weapon may be dispensed with.

Figure 9:
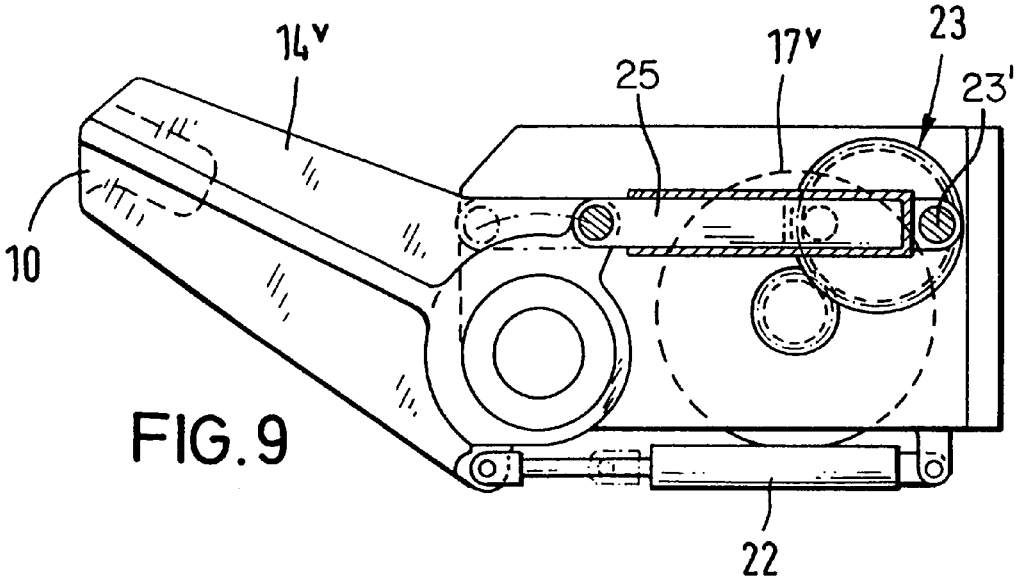

FIG. 9 shows an opening lever $\mathbf{14}^{V}$ coupled to a connecting rod 25 which, in turn, is articulated to a crank pin 23' affixed eccentrically to a crank wheel 23. The crank wheel 23 is rotated by the external drive $\mathbf{17}^{V}$ formed as an electric motor. In this embodiment too, a gas spring 22 is provided which, upon pivoting of the opening lever $\mathbf{14}^{V}$, is armed as it moves from its retracted position into its expanded position.

Figure 10:
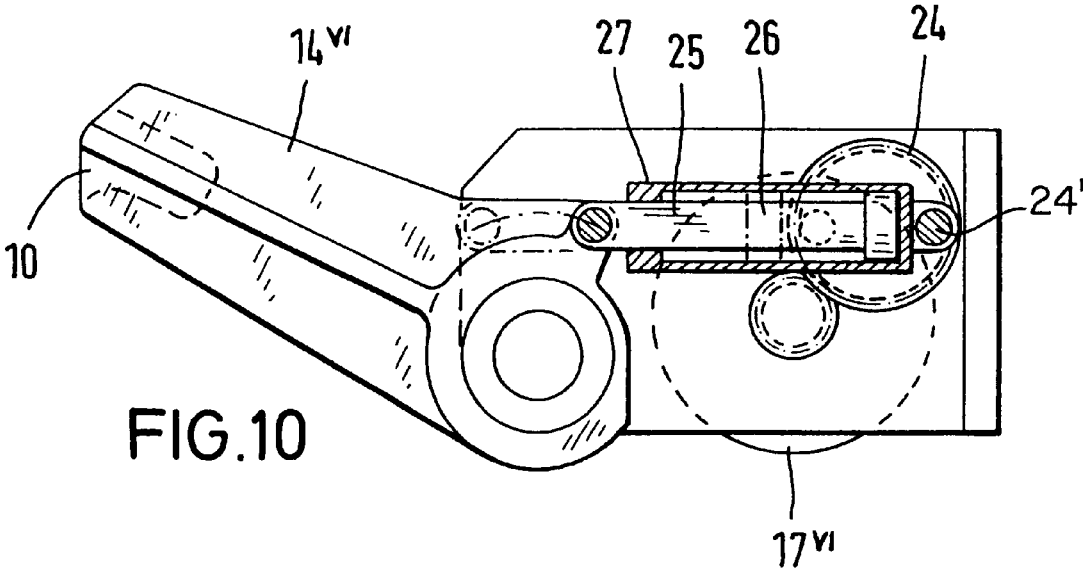

FIG. 10 shows an opening lever $\mathbf{14}^{VI}$ coupled to a connecting rod 25 which, in turn, is articulated to a crank pin 24' affixed eccentrically to a crank wheel 24. The crank wheel 24 is rotated by the external drive $\mathbf{17}^{VI}$. The crank pin 24' exerts a force on the connecting rod 25 having a piston 26 which is slidably arranged in a cylinder housing 27 in such a manner that it assumes the function of the closing spring.

Figure 11:
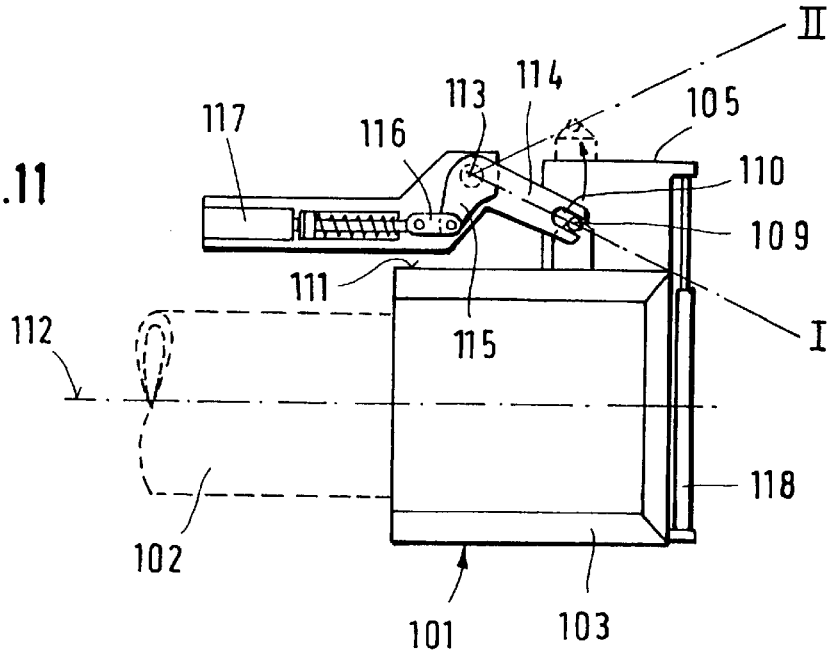
FIG. 11 is a side elevational view of a preferred embodiment of a vertical wedge-type breechblock according to the invention.
Figure 12:
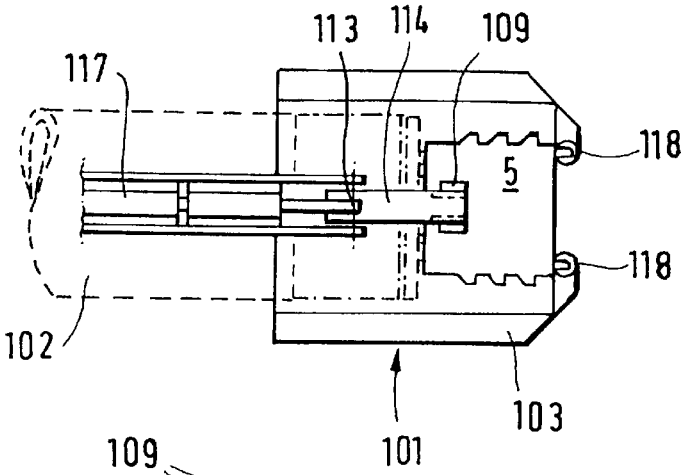
FIG. 12 is a top plan view of the structure shown in FIG. 11.
Figure 13:
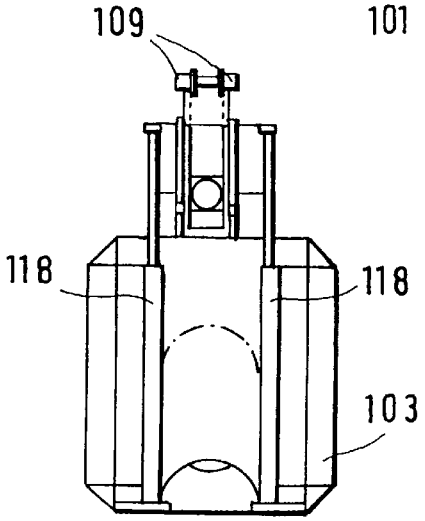
FIG. 13 is a rear elevational view of the construction shown in FIG. 12.

In FIGS. 11 and 12 a vertical wedge-type breechblock 101 is illustrated which includes a breech ring 103 connected with the weapon barrel 102 and a breech wedge 105 vertically shiftable in the breech ring 103.

The upper end of the breech wedge 105 carries a control lug 109 which extends into a recess of a fork 110 of an opening lever 114. The latter is situated above the upper side 111 of the breech ring 103 and is pivotal about a rotary axis 113 oriented perpendicularly to the barrel axis 112. Upon pivoting the opening lever 114 from its initial position I into its end position II, a shift of the breech wedge 105 occurs from its closed position into its open position. The opening lever 114 is pivotally mounted on the weapon cradle (not seen in FIGS. 11 and 12) and is, with its lever arm 115 remote from the control lug 109, connected by means of a schematically shown transmission linkage 116 with an external drive 117 (for example, an electric motor) also mounted on the weapon cradle.

During the opening process, for example, after firing the weapon, the external drive 117 shifts the linkage 116 and thus pivots the opening lever 114. The latter shifts the breech wedge 105 upwardly by means of the control lug 109. During this occurrence, two weight-compensating springs 118, mounted between the breech ring 103 and the breech wedge 105 exert an upward force on the breech wedge 105 and thus the opening forces to be applied by the opening lever 114 may be reduced. At the end of the opening stroke the ejector (not illustrated) is actuated and the cartridge case (or the cartridge bottom if the case is combustible) is pulled out. The completely opened breechblock is thereafter locked in the relaxed state of the weight-compensating springs 118.

Figure 14:
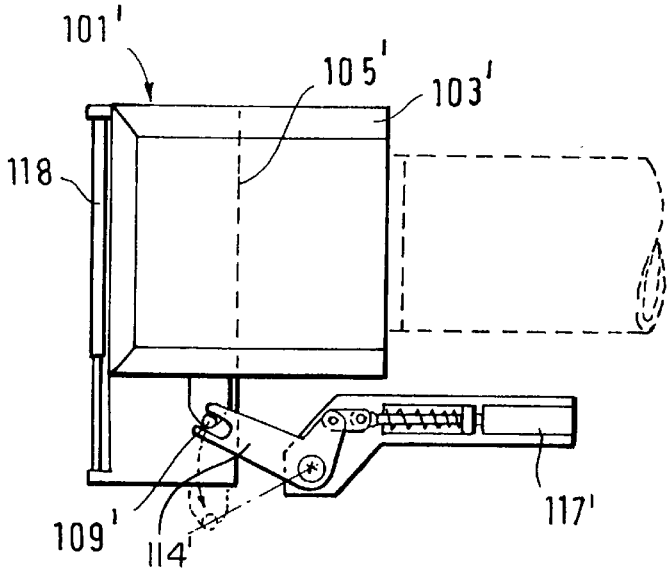
FIG. 14 is a side elevational view of a preferred embodiment of a drop wedge-type breechblock according to the invention.
Figure 15:
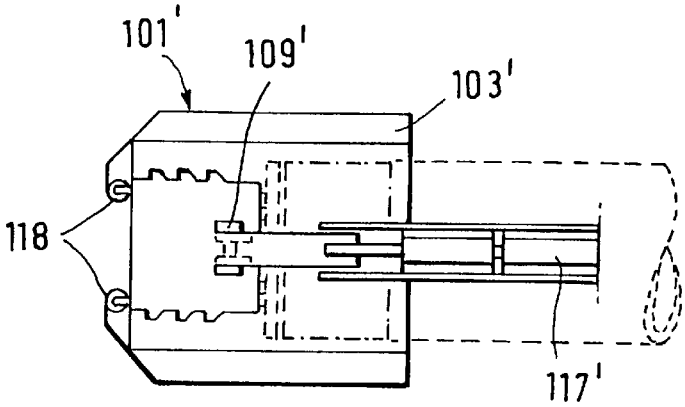
FIG. 15 is a top plan view of the structure shown in FIG. 14.
Figure 16:
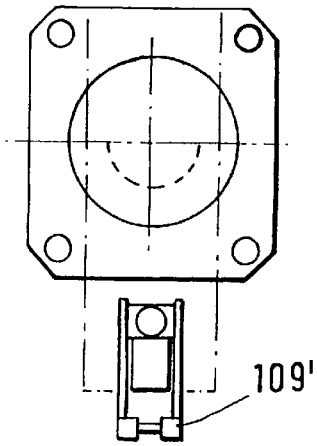
FIG. 16 is a rear elevational view of the construction shown in FIG. 15.

In FIGS. 14, 15 and 16 a drop wedge-type breechblock 101' according to the invention is illustrated. This embodiment differs essentially from the previously described vertical wedge-type breechblock 101 in that the control lug 109' mounted on the breech wedge 105' is secured to the lower end of the breech wedge 105' and further, the opening lever 114', the external drive 117' and the transmission linkage 116' are arranged underneath the breech ring 103'.

In the two embodiments illustrated in FIGS. 11–16 the mechanical connection between the opening levers 114, 114' and the external drives 117, 117' may be effected in a manner shown in the embodiments of FIGS. 6–10.

It will be understood that the above description of the present invention is susceptible to various modifications, changes and adaptations, and the same are intended to be comprehended within the meaning and range of equivalents of the appended claims.

What is claimed is:

1. A large-caliber weapon comprising (a) a barrel having a longitudinal barrel axis;

(b) a cradle supporting said barrel;

(c) a breech ring mounted on an end of said barrel;

(d) a breech wedge disposed in said breech ring for linear displacements transversely to said barrel axis; said breech wedge having open and closed positions;

(e) a control lug affixed to said breech wedge;

(f) an opening lever pivotally mounted on said cradle for angular displacements about a lever axis oriented perpendicularly to said barrel axis; said opening lever being disposed externally of said breech ring and having an initial position and an actuated end position; said opening lever being engaged by said control lug of said breech wedge in a position of rest of said barrel such that upon motion of said opening lever from said initial position to said actuated end position said breech wedge is moved from said closed position into said open position;

(g) an electric motor, constituting an external drive, mounted on said cradle; and (h) a crank drive, constituting a mechanical coupling mechanism, connecting said external drive to said opening lever for effecting pivotal motion of said opening lever.

2. The large-caliber weapon as defined in claim 1, wherein said breech ring has a lower side and said opening lever is situated at said lower side.

3. The large-caliber weapon as defined in claim 1, wherein said breech ring has an upper side and said opening lever is situated at said upper side.

4. The large-caliber weapon as defined in claim 1, further comprising a spring being connected to said opening lever such that said spring is armed by said opening lever upon movement thereof from said initial position into said actuated end position.

5. The large-caliber weapon as defined in claim 4, wherein said spring is a gas spring.

6. The large-caliber weapon as defined in claim 1, wherein said opening lever has a forked end engageable by said control lug.

7. The large-caliber weapon as defined in claim 1, wherein said breech wedge and said breech ring have rear faces oriented away from said barrel; said rear faces lying in a common plane.

8. The large-caliber weapon as defined in claim 1, wherein said breech ring and said breech wedge form a breechblock; said breechblock being a horizontal wedge-type breechblock.

9. The large-caliber weapon as defined in claim 8, wherein said breech wedge has a rear face oriented away from said barrel; said control lug being arranged on said rear face.

10. The large-caliber weapon as defined in claim 8, wherein said control lug is arranged on said breech wedge laterally thereof.

11. The large-caliber weapon as defined in claim 8, wherein said control lug is arranged in a lower region of said breech wedge.

12. The large-caliber weapon as defined in claim 8, wherein said control lug is arranged in an upper region of said breech wedge.

13. The large-caliber weapon as defined in claim 1, wherein said breech ring and said breech wedge form a breechblock; said breechblock being a vertical wedge-type breechblock.

14. The large-caliber weapon as defined in claim 13, wherein said control lug is arranged in an upper region of said breech wedge.

15. The large-caliber weapon as defined in claim 13, wherein said control lug is arranged in a lower region of said breech wedge.

16. The large-caliber weapon as defined in claim 13, further comprising a weight compensating spring connected between said breech ring and said breech wedge.

17. The large-caliber weapon as defined in claim 1, wherein said crank drive comprises a crank wheel, means for connecting said electric motor to said crank wheel for rotating said crank wheel by said electric motor and a crank pin affixed eccentrically to said crank wheel for orbital motion as said crank wheel rotates; further comprising a connecting rod coupled to said opening lever and said crank pin for moving said opening lever by said crank pin upon rotation of said crank wheel.

18. The large-caliber weapon as defined in claim 1, further comprising (i) a connecting rod coupled to said crank drive and said opening lever for moving said opening lever by said crank drive upon rotation of said crank drive;

(j) a cylinder housing through which said connecting rod passes; and (k) a piston affixed to said connecting rod and slidably engaging an inner wall of said cylinder housing; said connecting rod, said cylinder housing and said piston forming a gas spring connected to said opening lever such that said gas spring is armed upon movement of said opening lever from said initial position for urging said opening lever into said initial position.

* * * * *